US006709190B1

(12) United States Patent
Partin

(10) Patent No.: US 6,709,190 B1
(45) Date of Patent: Mar. 23, 2004

(54) DOUBLE-CROSS BARRICADE

(76) Inventor: James O. Partin, 898 Spring Creek Rd., Lafayette, TN (US) 37083

( * ) Notice: Subject to any disclaimer, the term of this patent is extended or adjusted under 35 U.S.C. 154(b) by 0 days.

(21) Appl. No.: 10/244,961

(22) Filed: Sep. 16, 2002

(51) Int. Cl.[7] ..... E01F 15/00
(52) U.S. Cl. ..... 404/6
(58) Field of Search ..... 404/6, 7, 8, 9; 256/13.1

(56) References Cited

U.S. PATENT DOCUMENTS

| | | | | | |
|---|---|---|---|---|---|
| 1,175,962 | A | * | 3/1916 | Latham | 405/31 |
| 1,449,518 | A | * | 3/1923 | Lawson | 256/13.1 |
| 2,313,388 | A | | 3/1943 | McDonald | |
| 2,346,713 | A | * | 4/1944 | Walker | 256/1 |
| 3,346,713 | A | | 4/1944 | Walker | |
| 4,759,606 | A | * | 7/1988 | McDowell | 359/553 |
| 5,122,797 | A | * | 6/1992 | Wanasz | 340/908.1 |
| 5,572,188 | A | * | 11/1996 | McDowell, II | 340/473 |
| 5,639,178 | A | | 6/1997 | Wilson | |
| 5,921,703 | A | | 7/1999 | Becker | |
| 5,975,791 | A | | 11/1999 | McCulloch | |
| 6,150,958 | A | * | 11/2000 | Worsham | 340/932.2 |
| 6,206,608 | B1 | | 3/2001 | Blevins | |
| 6,254,063 | B1 | * | 7/2001 | Rohde et al. | 256/13.1 |
| 6,533,249 | B2 | * | 3/2003 | Ochoa | 256/13.1 |

OTHER PUBLICATIONS

The Atlantic Wall, internet web site www.normandiemomoire.com, found Aug. 19, 2003 2 pages.*

* cited by examiner

*Primary Examiner*—Robert E. Pezzuto
*Assistant Examiner*—Raymond W Addie
(74) *Attorney, Agent, or Firm*—Charles Allen IV

(57) ABSTRACT

Portable vehicular barricade and vehicle disabling device consisting of three structural steel I-beams joined together at a central axis location at right angles to each other to form a large, 3-dimensional, x-shaped structure. When placed on the ground, the barricade will come to rest on three of the structural steel I-beam ends, forming a stable tripod I-beam base. The remaining three structural steel I-beam ends will be facing upwards and out from the central axis of the device. Upon impact of an on-coming vehicle, the tripod I-beam ends will dig into the ground while the steel I-beam ends facing upwards and out will tear through the vehicle's chassis and engine components, and at the same time, roll over with the vehicle's momentum to cause the barricade device to lodge itself under the vehicle, impeding any further forward motion of the vehicle, and possibly forcing the vehicle on its side or back.

2 Claims, 5 Drawing Sheets

Figure 1:
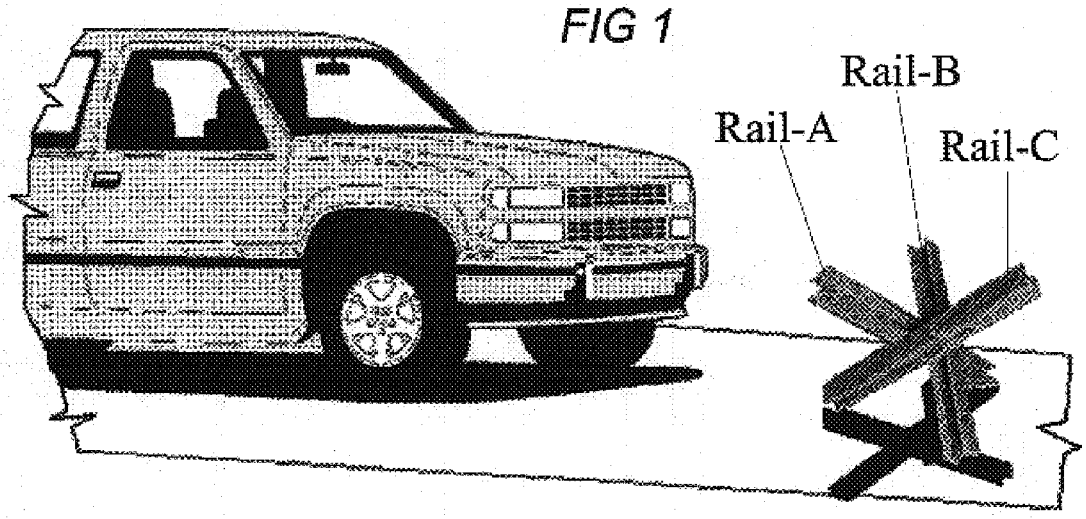

DOUBLE-CROSS BARRICADE
Assembled & Positioned

DOUBLE-CROSS BARRICADE
Assembled & Positioned

DOUBLE-CROSS BARRICADE
Rail-B Assembled to Rail-A

DOUBLE-CROSS BARRICADE

Assembly of Rail-C to Rails A & B

DOUBLE-CROSS BARRICADE

Rail-C Assembled to Rail-A & B

DOUBLE-CROSS BARRICADE

RELATED APPLICATIONS

Not Applicable

FEDERALLY SPONSORED RESEARCH

Not Applicable

MICROFICHE APPENDIX

Not Applicable

SEQUENCE LISTING OR PROGRAM

Not Applicable

BACKGROUND OF THE INVENTION (1) Field of the Invention

The invention is a portable barricade device designed to disable vehicles attempting to cross the barricade.

(2) Description of the Related Art

This invention relates to vehicular barricades and vehicular disablement devices. Law enforcement authorities, military personnel, and all other persons involved in security and enforcement are often confronted with the task of securing vehicular access-ways (e.g., roads, parking lots, walkways, etc.). This is becoming more of an issue as terrorist acts continue throughout the world. Americans are more aware of the threat of domestic violence in the United States after the September $11^{th}$ attack on the Twin Towers. The need for improved methods and devices to counter and guard against specific acts of vehicular terrorism (e.g., car bombs, armed and armored vehicles) is paramount. It was with this counter-terrorism thought in mind that the following security measure device came into being.

When streets are blocked off to prevent access, the most common means is to place a saw-horse type barricade at the access-way or utilize a concrete barricade. The saw-horse type of barricade works fine as an administrative barricade. It is portable and easy to set-up, but lacks strength and effectiveness should a vehicle choose to pass—the vehicle will simply run through the saw-horse. The concrete barricade is a very effective means of barricading a street, however it is difficult to use as it requires heavy equipment to place such a barricade and is quite time-consuming to do so. During World War II, devices similar to the double-cross barricade were found on beach fronts to impede the progress of troop landing amphibious vehicles.

Other prior art disclosures include different techniques to impede or prevent a vehicle's access. U.S. Pat. No. 3,346,713, to Walker, Apr. 18, 1944, discloses a caltrop with hollow spikes or "arms" designed to puncture pneumatic tires. This device is not designed to damage a vehicle's engine or engine components.

U.S. Pat. No. 2,313,388, to McDonald, Mar. 9, 1943, discloses a vehicle-impeding device for use against wheeled or tracked vehicles. The invention consists of a cup-like device, with several prongs extending upward and outward, with the intent to catch in solid or inflatable rubber tires in such a manner as to be difficult to disengage therefrom, and which, when so disengaged, causes considerable damage to the tires. This device is not designed to damage a vehicle's engine or engine components.

U.S. Pat. No. 6,206,608 B1, to Blevins, Mar. 27, 2001, discloses a vehicle disabling device for use against wheeled vehicles. The invention consists of a "carpet" of spikes designed to deflate tires and obstruct the free movement of the wheels. This device is not designed to damage a vehicle's engine or engine components.

U.S. Pat. No. 5,921,703, to Becker, Jul. 13, 1999, discloses a new and improved caltrop designed to disable vehicles with pneumatic tires. This device is not designed to damage a vehicle's engine or engine components.

U.S. Pat. No. 5,639,178, to Wilson, Jun. 17, 1997, discloses a vehicle barrier designed to control access to or from a vehicle park, parking space or controlled authorized zone. This device is not portable.

U.S. Pat. No. 5,975,791, to McCulloch, Nov. 2, 1999, discloses a vehicle security gate apparatus and method of operating same, to inhibit and control vehicular access. This device is not portable.

It is an object of the present invention to provide a barricade device that destroys a vehicle's engine and/or its components, ensuring full and total disablement of the vehicle, rather than simply attacking the vehicle's tires/tracks.

It is another object of the invention to provide a barricade device that lifts a vehicle off the ground and tilts it onto its side or back, stopping all forward progress of the vehicle.

It is another object of the invention to provide a barricade device that is easily stored, assembled, and deployed.

It is another object of the invention to provide a barricade device that is easily manufactured.

These and other objects of the invention will be apparent after reading the ensuing disclosure.

SUMMARY OF THE INVENTION

An object of the present invention is to provide a reliable device for securing vehicular access-ways and disabling automotive-type vehicles refusing to heed established barricades. By either destroying engine components, or gaining a position under the vehicle so as to lift the vehicle up (and its front wheels off the ground), or gaining a position under the vehicle such that the vehicle tilts on its side or tips over onto its back, the invention causes full disablement of the vehicle.

In its preferred embodiment, the invention has a rigid structure with the strength to easily support the weight of an automobile. In this preferred embodiment, the invention is completely portable and easy to assemble within minutes by a single individual. Rather than attacking a vehicle's tires/tracks, this device destroys the engine and/or its components, ensuring full and total disablement of the vehicle, and/or lifts vehicle off the ground or tilts it onto its side or back. The invention is easily stored and deployed, and easily manufactured.

DESCRIPTION OF THE DRAWINGS (1) FIG. 1 shows a perspective view of the double-cross barricade in operation, according to the preferred embodiment.

Figure 2A:
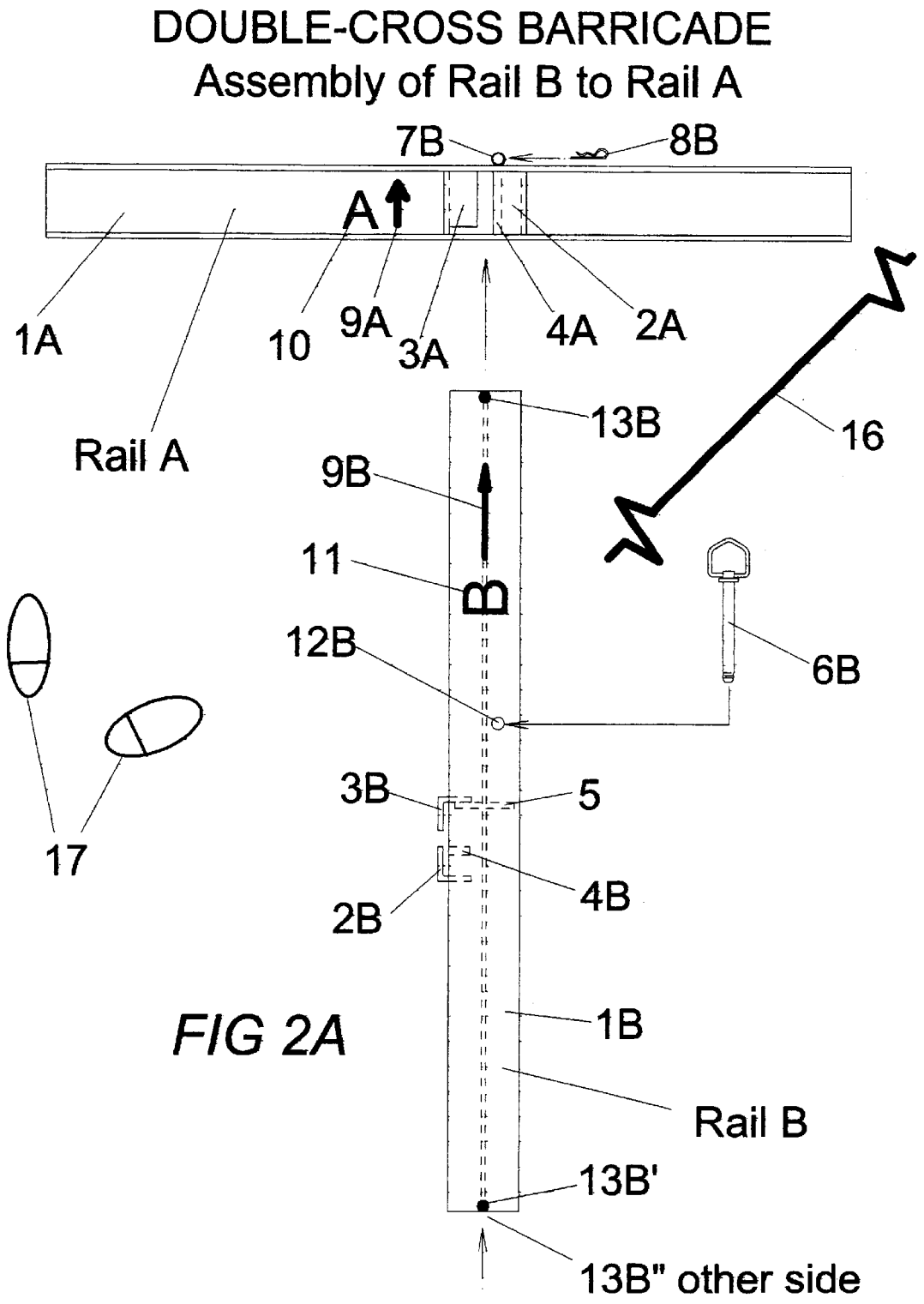

(2) FIG. 2A shows the design and assembly of Rail-B to Rail-A.

Figure 2B:
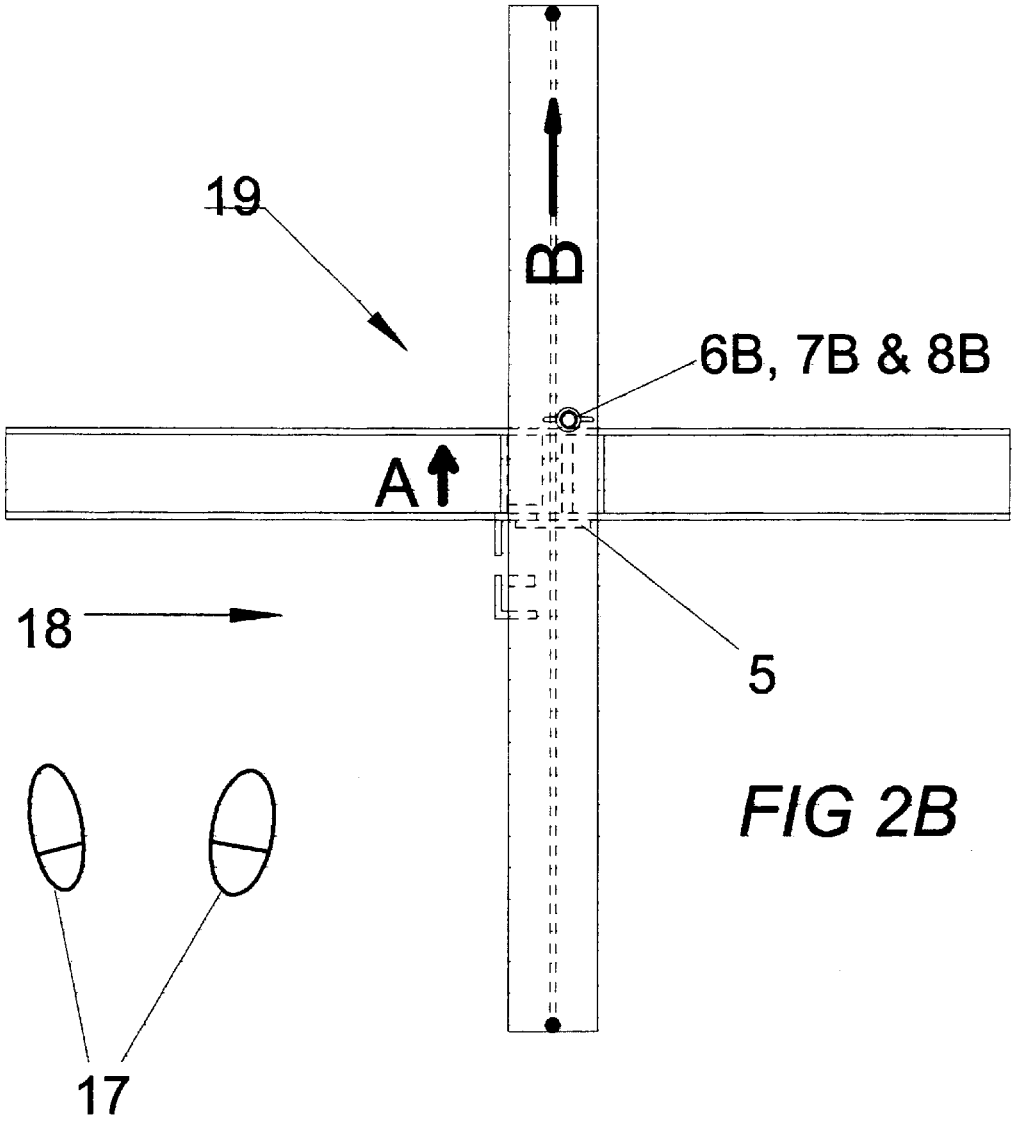

(3) FIG. 2B shows the proper installation of Rail-B into Rail-A.

Figure 3A:
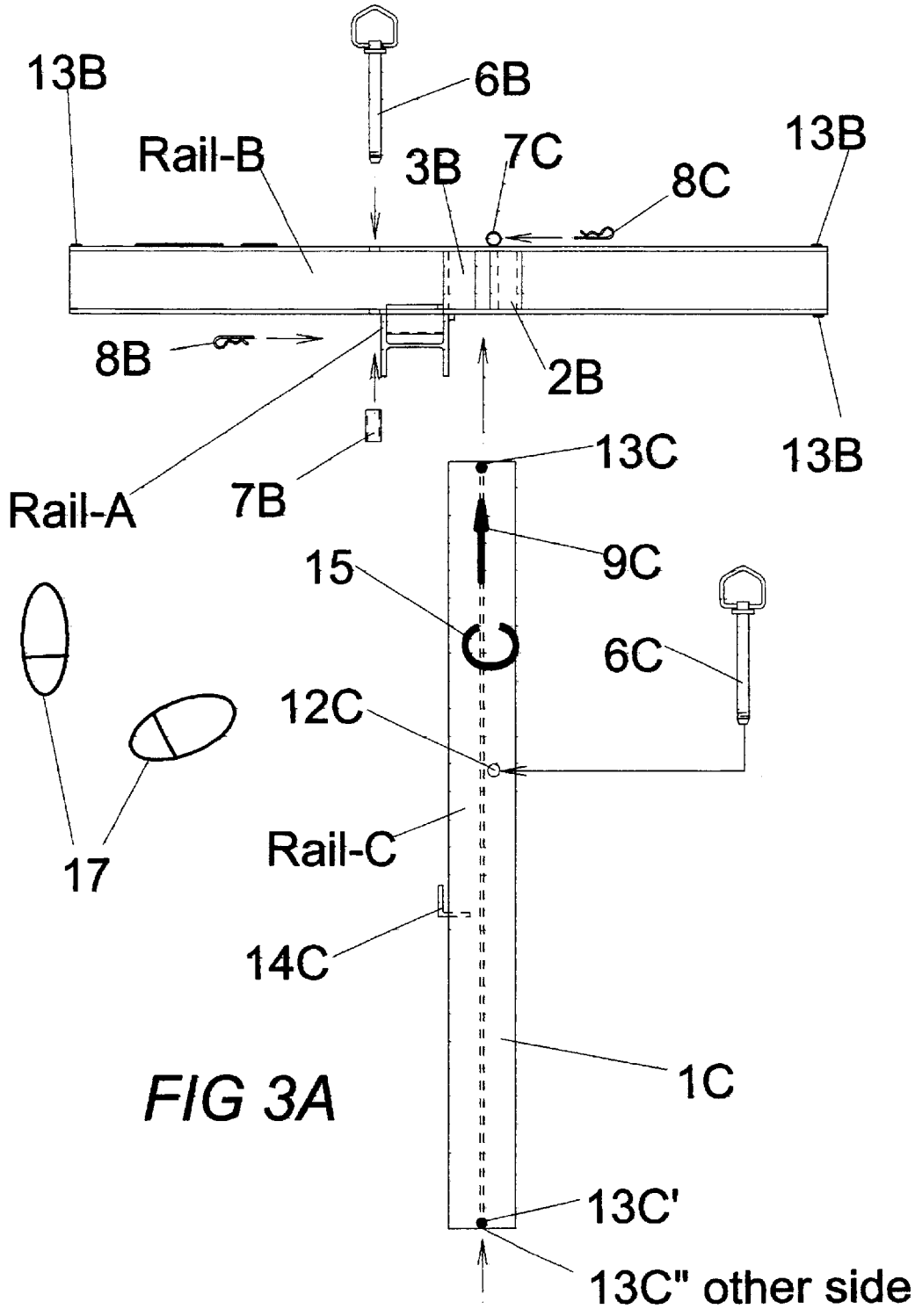

(4) FIG. 3A shows the design and assembly of Rail-C to Rail-A and Rail-B.

Figure 3B:
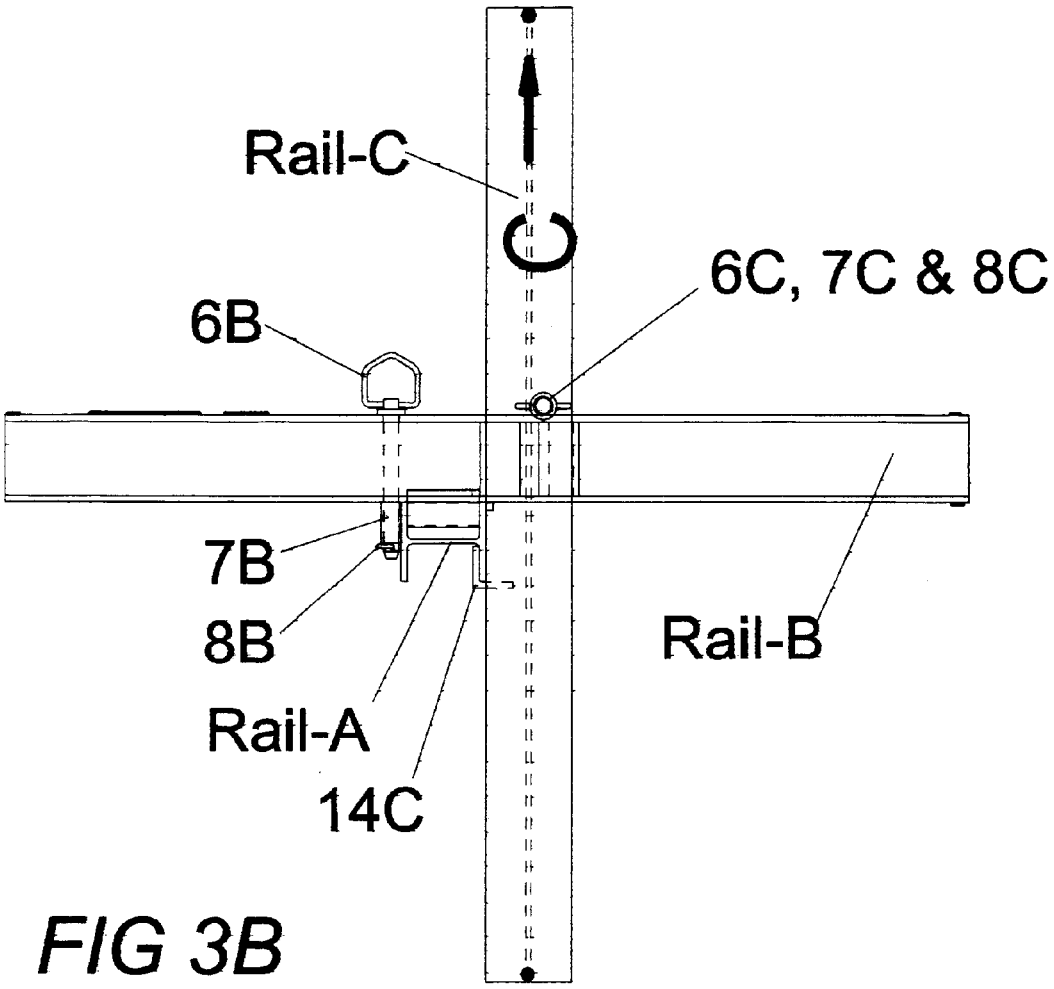

(5) FIG. 3B shows the proper installation of Rail-C into Rail-B and Rail-A.

LIST OF DRAWING REFERENCE NUMBERS

| | |
|---|---|
| 1A | structural I-Beam |
| 1B | structural I-Beam |
| 1C | structural I-Beam |
| 2A | rail guide |
| 2B | rail guide |
| 3A | rail guide |
| 3B | rail guide |
| 4A | locking pin brace |
| 4B | locking pin brace |
| 5 | slide stop |
| 6B | locking pin |
| 6C | locking pin |
| 7B | bushing |
| 7C | bushing |
| 8B | hitch pin clip |
| 8C | hitch pin clip |
| 9A | hand-welded "Arrow" |
| 9B | hand-welded "Arrow" |
| 9C | hand-welded "Arrow" |
| 10 | hand-welded letter "A" |
| 11 | hand-welded letter "B" |
| 12B | locking pin hole |
| 12C | locking pin hole |
| 13B | hand-welded prevent button |
| 13B' | hand-welded prevent button |
| 13B" | hand-welded prevent button |
| 13C | hand-welded prevent button |
| 13C' | hand-welded prevent button |
| 13C" | hand-welded prevent button |
| 14C | slide stop |
| 15 | hand-welded letter "C" |
| 16 | assembly set-up angle |
| 17 | assembler's feet placement |
| 18 | direction of assembly view |
| 19 | assembly set-up direction |

DETAILED DESCRIPTION OF THE INVENTION

A preferred embodiment of the double-cross barricade is illustrated in FIG. 1, which shows a perspective view of the double-cross barricade in operation. Three structural steel I-beams, referred to as Rail-A, Rail-B, and Rail-C, are connected at a central axis position at perpendicular right angles to each other, forming a large three-dimensional, X-shaped barricade. As the structural steel I-beams, Rail-A, Rail-B, and Rail-C, are each approximately 1.219 meters (four feet) in length, upon final construction, the double-cross barricade is at a height sufficient to rip through the engine chassis of a family size, four-door sedan automobile upon an automobile's impact, and allowing the barricade to lodge itself under the vehicle, thereby lifting the vehicle off its front wheels, and/or tipping the vehicle onto its side or back.

Additional embodiments include increasing the size in length and/or girth of the steel I-beams for greater effectiveness against larger vehicles, including pickup trucks, vans, armored cars, buses, semi-trucks and trailers, etc.

Although steel is the preferred material of construction for the double-cross barricade, other materials may be used, provided they have the strength and structural support to accomplish the goal of the double-cross barricade. This goal is to rip and tear through an automobile chassis, and support the weight of the vehicle, without the barricade coming apart.

The central axis or connecting point location of the double-cross barricade may be designed and located at a position other than the center of the beams to facilitate the barricade's use on different forms of terrain or against a specific vehicular threat.

(1) Objects and Advantages

Several objects and advantages of the double-cross barricade include:

(a) Rather than attacking a vehicle's tires/tracks, the double-cross barricade destroys the engine and/or its components, ensuring full and total disablement of the vehicle.

(b) The double-cross barricade lifts the vehicle off the ground and tilts it onto its side or back, ensuring full and total disablement of the vehicle.

(c) The double-cross barricade is easily stored.

(d) Being portable, the double-cross barricade is easily deployed.

(e) The double-cross barricade is easily manufactured.

(f) One person can easily assemble the double-cross barricade.

(2) Presently Preferred Method for Constructing the Presently Preferred Embodiment of the Double-Cross Barricade The double-cross barricade consists of three major rail weldments: Rail-A, Rail-B and Rail-C, FIG. 1, with two locking pin sets. Each locking pin set consists of a standard 1.905 cm×15.24 cm (¾ inch×6 inch) hitch pin, with a hitch pin clip (TSC# 02-6882-8). Hitch pin clips are also known as hair pins. Two standard 1.984 cm (25/32 inch) inside diameter×(1 inch) outside diameter×5.00 cm (1 31/32 inch) long top link bushings (TSC# 02-6844-6) are also required.

(A) Rail-A Construction

Rail-A, in FIG. 2A, is constructed of a 10.16 cm (4 inch) hot roll wide flange structural I-beam 1A 1.219 meters (four feet) long for a standard length. Longer lengths for providing effective barricades against larger vehicles may also be used. A locking pin brace 4A 1.27 cm×3.175 cm (½ inch×1¼ inch) hot roll steel, 9.207 cm (3⅝ inch) long is used for support after installing Rail-B. Rail guide 2A is 5.08 cm×5.08 cm×0.794 cm (2 inch×2 inch×5/16 inch) hot roll angle iron, 9.207 cm (3⅝ inch) long. The rail guides are square and parallel with the edge of structural I-beam 1A. To ensure that the angle iron guides are square and parallel to each other, a locating fixture built specifically for this purpose is used. Another rail guide 3A is also made of 5.08 cm×5.08 cm×0.794 cm (2 inch×2 inch×5/16 inch) hot roll angle iron, 9.207 cm (3⅝ inch) long. The rail guide 3A must also be square and parallel with the edge of structural I-beam 1A. Located on the end opposite the arrow, on this guide, is a notch approximately 0.953 cm×4.286 cm (⅜ inch×1 11/16 inch) to allow for clearance of the welded bead on angle iron rail guide 3B on Rail-B, when the two parts are assembled. The two rail guides 2A, 3A must be welded on the inside before the locking pin brace 4A for Rail-B is installed. The hand-welded "Arrow" 9A and the hand-welded letter "A" 10 are used to aid in the correct assembly of Rail-A and Rail-B.

(B) Rail-B Construction

Rail-B, in FIG. 2A, is constructed of a 10.16 cm (4 inch) hot roll wide flange structural I-beam 1B 1.219 meters (four feet) long for a standard length. Longer lengths for providing effective barricades against larger vehicles may also be used. A locking pin brace 4B 1.27 cm×3.175 cm (½ inch×1¼ inch) hot roll steel, 9.207 cm (3⅝ inch) long is used for support after installing Rail-C. Rail guides 2B, 3B are 5.08 cm×5.08 cm×0.794 cm (2 inch×2 inch×5/16 inch) hot roll angle iron, 9.207 cm (3⅝ inch) long. The rail guides are square and parallel with the edge of structural I-beam 1B. One slide stop 5 0.953 cm×0.953 cm (⅜ inch×⅜ inch) cold roll steel, 8.89 cm (3½ inch) long, must be square with the edge of Rail-B and in-line with the inside edge of the rail guide 3B. To ensure that the angle iron guides and slide stop are square and parallel to each other, a locating fixture built specifically for this purpose is used. The two rail guides 2B, 3B must be welded on the inside before the locking pin brace 4B for Rail-C is installed. One locking pin hole 12B is drilled through both flanges, which are aligned with each other at a distance from the slide stop 5 to allow clearance for Rail-A and the wall thickness of bushing 7B. The hand-welded "Arrow" 9B and the hand-welded letter "B" 11 and three hand-welded prevent buttons 13B, 13B', 13B" are used to aid in the correct assembly of Rail-A and Rail-B.

(C) Rail-C Construction

Rail-C, in FIG. 3A, is constructed of a 10.16 cm (4 inch) hot roll wide flange structural I-beam 1C 1.219 meters (four feet) long for a standard length. Longer lengths for providing effective barricades against larger vehicles may also be used. A slide stop 14C 5.08 cm×5.08 cm×0.794 cm (2 inch×2 inch×5/16 inch) hot roll angle iron, 9.207 cm (3⅝ inch) long, is square and parallel with Rail-C. To ensure that the slide stop is square and parallel with Rail-C, a locating fixture built for this purpose is used. A locking pin hole 12C is drilled through both flanges and aligned with each other at a distance from the inside edge of slide stop 14C to allow clearance for both Rail-A and Rail-B plus the wall thickness of bushing 7C. The hand-welded "Arrow" 9C and the hand-welded letter "C" 15 and three hand-welded prevent buttons 13C, 13', 13C" are used to aid in the correct assembly of Rail-C to Rails-A and B.

(D) Painting Rails-A, B, and C

Wire brush, sand or vapor blast all three rails. Wipe clean with a dry cloth and spray paint one coat of primer paint. Let dry, lightly sand and paint with a red fluorescent paint. Other colors may be used.

(3) Assembly and Positioning of the Double-Cross Barricade (A) Assembling Rail-B to Rail-A Lay Rail-A on the ground at a 45 degree angle to the side of the road for the appropriate assembly set-up angle 16 (FIG. 2A) with the left end back and the right end forward, with the rail guides 2A, 3A facing up. The hand-welded letter "A" 10 on the left hand side and the hand-welded "Arrow" 9A points away from the assembler's feet placement 17 and to the left at 45 degrees. Place Rail-B into the Rail-A rail guides 2A, 3A by placing the "Arrow" end of Rail-B into the rail guide first. This is the end without the hand-welded prevent button 13B (FIGS. 2A, 3A). With the hand-welded "Arrow" 9A and the hand-welded letter "B" 11 on top, slide Rail-B into the rail guides in the direction of the "Arrows" until the slide stop 5 (FIG. 2B) on the bottom of Rail-B, contacts the edge of Rail-A. This will form a big "X" in the road. Slide the locking pin 6B through the top of Rail-B, through the drilled locking pin hole 12B until it comes to a stop at its shoulder. Then slide the bushing 7B over the end of the locking pin 6B and snap in the hitch pin clip 8B in the small hole at the end of the locking pin 6B (FIGS. 2A, 2B, 3A, and 3B.) As an option, Rail-A can be manufactured with the bushing 7B already welded in place.

(B) Assembling Rail-C to Rail-B and Rail-A

With Rail-B on the right hand side of the assembler's feet placement 17 (FIG. 2B) and Rail-A in front, step over the letter "A" welded on Rail-A. Turn around and with the help of another person, stand the unit up in the direction of the "Arrow". This is the assembly set-up direction 19. The rail guides 2B, 3B (FIG. 3A) for Rail-C will be on the right hand side of the standing big "X". With Rail-A the closest rail to the person inserting Rail-C (which is now the opposite side of the previous assembly), insert Rail-C into Rail-B, FIG. 3A. FIG. 3A is viewed from the end of Rail-A for clarity. (See 18, FIG. 2B, for direction of this assembly view.) With the hand-welded "Arrow" 9C and the hand-welded letter "C" 15 on the top right and the slide stop 14C on the top left (the Rail-A side), slide Rail-C in, until the slide stop 14C is hooked over the flange of Rail-A and the inside edge of slide stop 14C (FIG. 3B) is as far as it will go against the outside edge of Rail-A. Slide the remaining locking pin 6C (or hitch pin) through the top of Rail-C, through the locking pin hole 12C on the other side until it comes to a stop at its shoulder. Then slide the other bushing 7C over the end of the locking pin 6C and snap in the hitch pin clip 8C in the small hole at the end of the locking pin 6C. As an option, Rail-B can be manufactured with the bushing 7C already welded in place.

(C) Setting up the Double-Cross Barricade Alone

If the assembler is setting up the double-cross barricade without an assistant, this procedure should be followed: Assemble Rail-A and Rail-B as stated above. With Rail-B on the right hand side of the assembler's feet placement 17 (FIG. 2B) and Rail-A in front, step over the letter "A" welded on Rail-A to the second position. Turn around and raise the assembled unit in the direction of the arrow, and the assembly set-up angle 19. With the big "X" standing on two legs, walk around to the other side, supporting the standing unit as you do so. Lay the big "X" back down on the ground, pulling it towards you. In other words, turn the big "X" over onto the Rail-B side. Now step back over to the second position and insert the end of Rail-C into Rail-B with the hand-welded "Arrow" 9C and hand-welded letter "C" 15 on the top right and the slide stop on the top left (the Rail-A side). Drop it vertically until it makes contact with the ground. Using Rail-C as a lever, pull Rail-C towards you until it is parallel with the ground and the big "X" is standing once again. Hold and support the big "X" with your left hand and slide Rail-C in with your right hand, until the slide stop 14C is hooked over the flange of Rail-A and the inside edge of the slide stop 14C is as far as it will go against the outside edge of Rail-A. Install locking pin 6C (or hitch pin) through the top of Rail-C, through the locking pin hole 12C on the other side until it comes to a stop at its shoulder. Slide the other bushing 7C over the end of the locking pin 6C and snap in the hitch pin clip 8C in the small hole at the end of the locking pin 6C. The main difference between the one-man procedure and the two-man procedure is a means of starting Rail-C into Rail-B on the ground, instead of standing up, without having the assembled Rail-A and Rail-B falling over while trying to insert Rail-C.

(D) Operation and Positioning of the Double-Cross Barricade

Roll the completed unit back down towards the assembler, on three points so the hand-welded "Arrows" 9A, 9B, 9C on all three rails are pointing upward. Turn the double-cross barricade with the tops of Rail-A and Rail-B facing the traffic side. (See FIG. 1). This is the strongest set-up, although other configurations are possible and acceptable. If a vehicle attempts to break through the barricade, it will strike the upper-most portions of Rail-A and Rail-B, causing the two ends to rip into the chassis of the vehicle causing extensive damage to the engine and its components. The ends of the tripod base (from Rail-A and Rail-B) will dig into the ground upon impact. The double-cross barricade will then turn over due to the vehicle's momentum, rotating the bottom of Rail-C to the top, impaling the bottom of the vehicle, lifting it off the ground, and ending its forward motion.

(4) Conclusions, Ramifications, and Scope

In conclusion, the double-cross barricade combines the best features in various prior art in one invention. As a barricade, it is portable, extremely strong, easily seen, easy to manufacture, easy to store and deploy, and easy to assemble. As a vehicular disabling device, it can rip through an on-coming vehicle's chassis upon impact and cause extreme damage to the engine and its various components. It is strong enough to lodge under an on-coming vehicle and lift the vehicle off the ground, tip it to one side or the other, and with enough force, even on its back.

By increasing the size of the barricade, its functionality may encompass larger automotive vehicles, including vans, pickup trucks, armored cars, and semi-trucks/trailers. By changing the position of the central axis point (other than the center of the rails), different configurations of the double-cross barricade may be developed based on terrain, weather, threat, etc.

The double-cross barricade has been described with reference to a preferred embodiment, but various modifications and variations would be obvious to one of ordinary skill in the art. The description of the preferred embodiment is not intended to be limited.

I claim:

1. A portable vehicular barricade and vehicle disabling device comprising:

(a) a plurality of structural steel I-beams, (b) a plurality of locking pin sets, (c) a plurality of top link bushings, (d) means for joining said structural steel I-beams together at a central axis location, resulting in an x-shaped, steel I-beam structure capable of supporting the weight of an automobile when placed upon the ground, with steel I-beam arms radiating outward from said central axis location, whereby any vehicular impact upon said x-shaped, steel I-beam structure will result in said steel I-beam arms ripping and tearing apart the vehicle's engine and chassis, and/or said x-shaped, steel I-beam structure lodging under said vehicle causing the front wheels to elevate off the ground, and/or said x-shaped, steel I-beam structure lodging under said vehicle causing it to flip over onto its side or back, any of which such actions will hinder any further forward progress of said vehicle.

2. A portable vehicular barricade and vehicle disabling device comprising:

(a) three structural steel I-beams, each said structural steel I-beam between three and six feet in length, (b) two locking pin sets, (c) two top link bushings, (d) means for joining said structural steel I-beams together at a central axis location at perpendicular angles to each other forming a 3-dimensional, x-shaped, steel I-beam structure, said x-shaped, steel I-beam structure to act as a vehicular barricade and vehicle disabling device, capable of supporting the weight of an automobile when placed upon the ground, with steel I-beam arms radiating outward from said central axis location, whereby any vehicular impact upon said x-shaped, steel I-beam structure will result in said steel I-beam arms ripping and tearing apart the vehicle's engine and chassis, and/or said x-shaped, steel I-beam structure lodging under said vehicle causing the front wheels to elevate off the ground, and/or said x-shaped, steel I-beam structure lodging under said vehicle causing it to flip over onto its side or back, any of which such actions will hinder any further forward progress of said vehicle.

* * * * *